US006836062B2

(12) United States Patent
Lee et al.

(10) Patent No.: US 6,836,062 B2
(45) Date of Patent: Dec. 28, 2004

(54) CATHODE RAY TUBE HAVING COLOR SELECTION APPARATUS

(75) Inventors: Jun-Jong Lee, Seoul (KR); Ki-Youn Jun, Seoul (KR); Jong-Han Rhee, Suwon (KR)

(73) Assignee: Samsung SDI Co., Ltd., Suwon-Si (KR)

( * ) Notice: Subject to any disclaimer, the term of this patent is extended or adjusted under 35 U.S.C. 154(b) by 137 days.

(21) Appl. No.: 10/372,147

(22) Filed: Feb. 25, 2003

(65) Prior Publication Data

US 2003/0214214 A1 Nov. 20, 2003

(30) Foreign Application Priority Data

May 14, 2002 (KR) ..... 2002-26490
Sep. 13, 2002 (KR) ..... 10-2002-0055697

(51) Int. Cl.[7] ..... H01J 29/70
(52) U.S. Cl. ..... 313/402; 313/408; 315/370; 315/368.11
(58) Field of Search ..... 313/402, 407, 313/408, 403; 315/370, 382, 382.1, 368.11

(56) References Cited

U.S. PATENT DOCUMENTS 5,055,736 A * 10/1991 Yun et al. ..... 313/402
5,107,188 A * 4/1992 Rindal ..... 315/370
5,378,959 A * 1/1995 Mancini ..... 313/402
5,525,858 A * 6/1996 Berton et al. ..... 313/402
5,619,094 A * 4/1997 Vriens ..... 313/402
5,877,586 A * 3/1999 Aibara ..... 313/402
6,642,642 B1 * 11/2003 Watanabe et al. ..... 313/402
6,674,225 B2 * 1/2004 Jung ..... 313/402

* cited by examiner

*Primary Examiner*—Ashok Patel
(74) *Attorney, Agent, or Firm*—Staas & Halsey LLP

(57) ABSTRACT

A cathode ray tube including a tube realized through a face panel, a funnel, and a neck; a color selection apparatus including a shadow mask having a an effective area with apertures and a mask frame supporting the shadow mask; an electron gun mounted in the neck and emitting electron beams; a deflection apparatus generating a magnetic field to deflect the electron beams; and a moire compensation circuit performing moire compensation, wherein the color selection apparatus satisfies the following condition, $$0.76 \geq \frac{Ke}{Ko} \geq 0.85$$

where Ko and Ke are K values respectively at a center point and a horizontal end of the effective area, and wherein K satisfies the following condition, $$K = \frac{DL}{Pv} \times \frac{Bs}{Ps}$$

where DL and Pv are respectively a vertical length and a vertical pitch of the apertures, and Bs and Ps are respectively a vertical diameter and a vertical pitch of the electron beams landing on the effective area.

8 Claims, 7 Drawing Sheets

CATHODE RAY TUBE HAVING COLOR SELECTION APPARATUS

CROSS-REFERENCE TO RELATED APPLICATIONS

This application claims the benefit of Korean Patent Application No. 2002-26490 filed on May 14, 2002 and Korean Patent Application No. 2002-55697 filed on Sep. 13, 2002, in the Korean Intellectual Property Office, the disclosures of which are incorporated herein by references.

BACKGROUND OF THE INVENTION (a) Field of the Invention

The present invention relates to a cathode ray tube. More particularly, the present invention relates to a cathode ray tube having a color selection apparatus realized by a shadow mask that includes a plurality of apertures separating electron beams and a mask frame that supports the shadow mask.

(b) Description of the Related Art

A cathode ray tube (CRT) is generally a display device in which three electron beams emitted from an electron gun scan a phosphor screen to realize predetermined images. A color selection apparatus is provided within a tube and at a position adjacent to the phosphor screen. The color selection apparatus includes a shadow mask and a mask frame, and acts to separate the three electron beams so that the electron beams land correctly on red (R), green (G), and blue (B) phosphor layers of the phosphor screen.

With the typical shadow mask, that is, the typical dome-shaped shadow mask as opposed to the aperture grill type shadow mask, apertures are formed by an etching process. Non-etched areas between the apertures in a vertical direction of the screen are referred to as bridges, and predetermined portions of the electron beams are blocked by the bridges during the scanning process.

Accordingly, an alternating dark and bright pattern appears on the CRT screen, resulting in the occurrence of a moire phenomenon when such patterns are viewed by users. The moire phenomenon occurs according to a moire wavelength and a moire intensity. Typically, the moire wavelength is generated by interference from the cyclical repetition of the bridges and a wavelength of scanning lines, while moire intensity depends mainly on a size of the electron beams and a length of the bridges.

The moire intensity measurement is proportional to a density of electron beams passing through the shadow mask and a density of electron beams blocked by the bridges. Accordingly, in order to reduce moire intensity, the size of the electron beams must be reduced, a structure of a deflection apparatus or of an electron gun must be altered, and/or the shape and size of the apertures must be adjusted, etc.

U.S. Pat. Nos. 5,378,959, 5,619,094, and 5,525,858 disclose configurations to minimize the moire phenomenon.

During operation of CRTs, picture distortion becomes greater as the electron beams are deflected toward the peripheries of the screen. The electron beams that are deflected to horizontal edges of the screen experience an increase in their horizontal diameters and a reduction in their vertical diameters. This results in the vertical diameters of the electron beams landing on the horizontal edges of the screen being reduced to approximately 70% of the vertical diameters of the electron beams landing at the center of the screen.

Such a reduction in the vertical diameters of the electron beams results in an increase in the moire intensity at the horizontal edges of the screen such that moire patterns are formed at these areas of the screen as shown in FIG. 8 (the areas of the screen where the moire patterns are formed are indicated by the diagonal lines).

The moire patterns may be reduced by using a moire compensation circuit. However, when there is a high moire intensity, a moire pattern remains even with the operation of the moire compensation circuit resulting in the deterioration of screen characteristics. A variable focus voltage of the electron gun may be adjusted to increase the vertical diameter of the electron beams at horizontal edges of the screen to decrease distortion, however, doing so decreases focus characteristics of the electron beams.

Therefore, a vertical pitch of the apertures and a length of the bridges must be carefully selected to correspond to variations in vertical beam diameters of the electron beams to reduce moire intensity. However, since the vertical pitch of the apertures and the length of the bridges are closely related to the structural strength of the shadow mask and the tolerance of the screen, such choices in the dimensions of the apertures and bridges must be made with great care.

SUMMARY OF THE INVENTION

In one aspect, the present invention provides a cathode ray tube with a color selection apparatus that inhibits an increase in moire intensity caused by a reduction in a vertical diameter of electron beams, thereby preventing the occurrence of a moire phenomenon at peripheral portions of a screen to ultimately result in an improvement in picture quality.

In one embodiment, a cathode ray tube includes a tube realized through a face panel on an inner surface of which a phosphor screen is formed, a funnel is connected to the face panel, and a neck is connected to the funnel. A color selection apparatus includes a shadow mask having a plurality of apertures formed in an effective area of the shadow mask for the passage of electron beams and a mask frame mounted to an inside of the face panel while fixedly supporting the shadow mask. An electron gun is mounted within the neck and emitting three electron beams toward the phosphor screen. A deflection apparatus is mounted to an outer circumference of the funnel and generating a deflecting magnetic field in a path of the electron beams to deflect the electron beams. A moire compensation circuit is included in a circuit portion connected to the deflection apparatus, the moire compensation circuit causing interference in a deflecting signal supplied to the deflection apparatus to perform moire compensation, wherein the color selection apparatus satisfies the following condition, $$0.76 \geq \frac{Ke}{Ko} \geq 0.85$$

where Ko is a K value at a center point of the effective area and Ke is a K value at a horizontal end of the effective area; and wherein K satisfies the following condition, $$K = \frac{DL}{Pv} \times \frac{Bs}{Ps}$$

where DL is a vertical length of the apertures, Pv is a vertical pitch of the apertures, Bs is vertical diameter of the electron beams landing on the effective area, and Ps is a vertical pitch of the electron beams landing on the effective area.

According to another aspect, a cathode ray tube with the color selection apparatus includes a tube realized through a face panel on an inner surface of which a phosphor screen is formed, a funnel is connected to the face panel, and a neck is connected to the funnel. A color selection apparatus includes a shadow mask having a plurality of apertures formed in an effective area of the shadow mask for the passage of electron beams and a mask frame mounted to an inside of the face panel while fixedly supporting the shadow mask. An electron gun mounted within the neck emits three electron beams toward the phosphor screen. A deflection apparatus mounted to an outer circumference of the funnel generates a deflecting magnetic field in a path of the electron beams to deflect the electron beams, wherein the color selection apparatus satisfies the following condition:

$$0.80 \geq \frac{Ke}{Ko} \geq 0.85$$

where Ko is a K value at a center point of the effective area and Ke is a K value at a horizontal end of the effective area, and wherein K satisfies the following condition, $$K = \frac{DL}{Pv} \times \frac{Bs}{Ps}$$

where DL is a vertical length of the apertures, Pv is a vertical pitch of the apertures, Bs is vertical diameter of the electron beams landing on the effective area, and Ps is a vertical pitch of the electron beams landing on the effective area.

Additional aspects and advantages of the invention will be set forth in part in the description which follows and, in part, will be obvious from the description, or may be learned by practice of the invention.

BRIEF DESCRIPTION OF THE DRAWINGS

These and/or other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
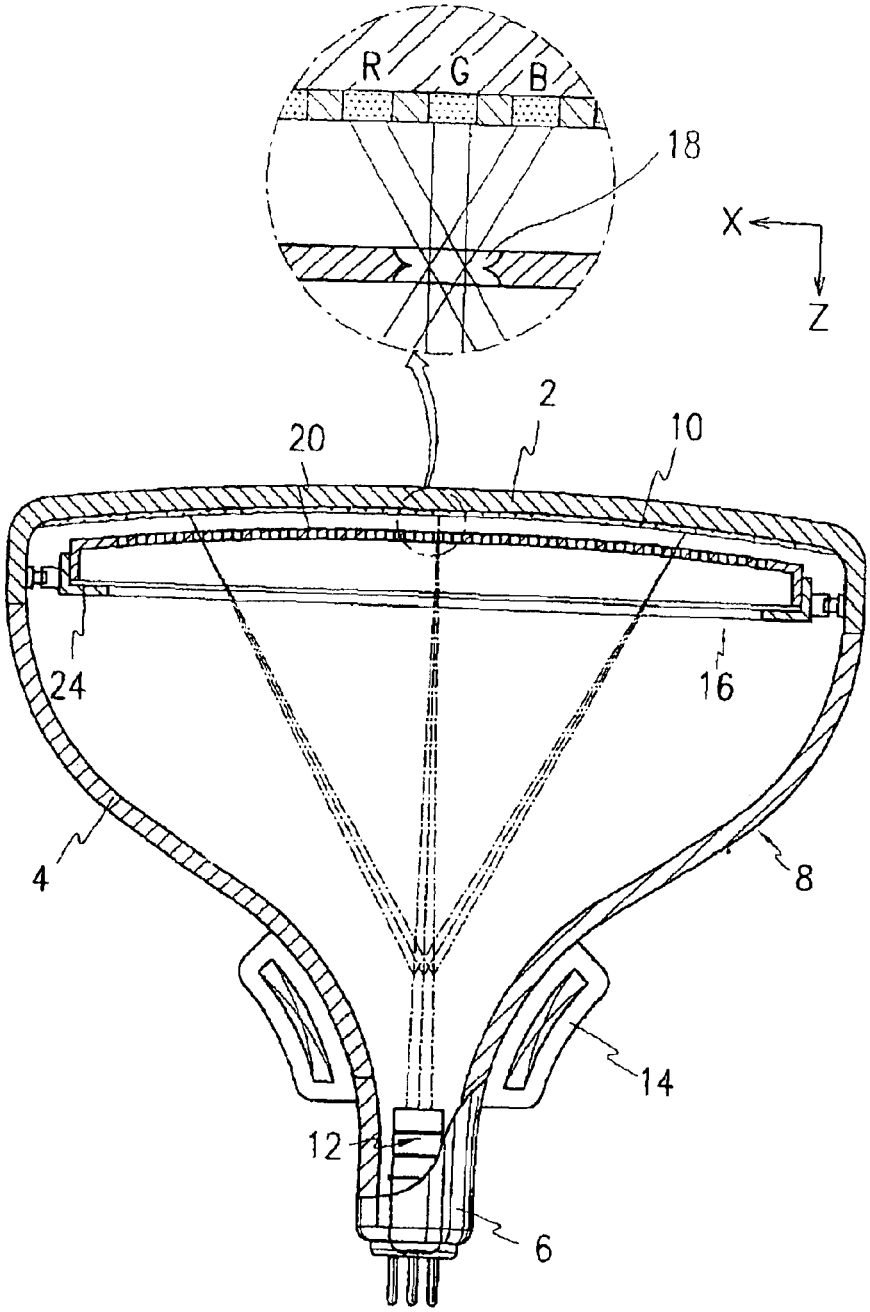
FIG. 1 is partially cutaway sectional view of a cathode ray tube according to an embodiment of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
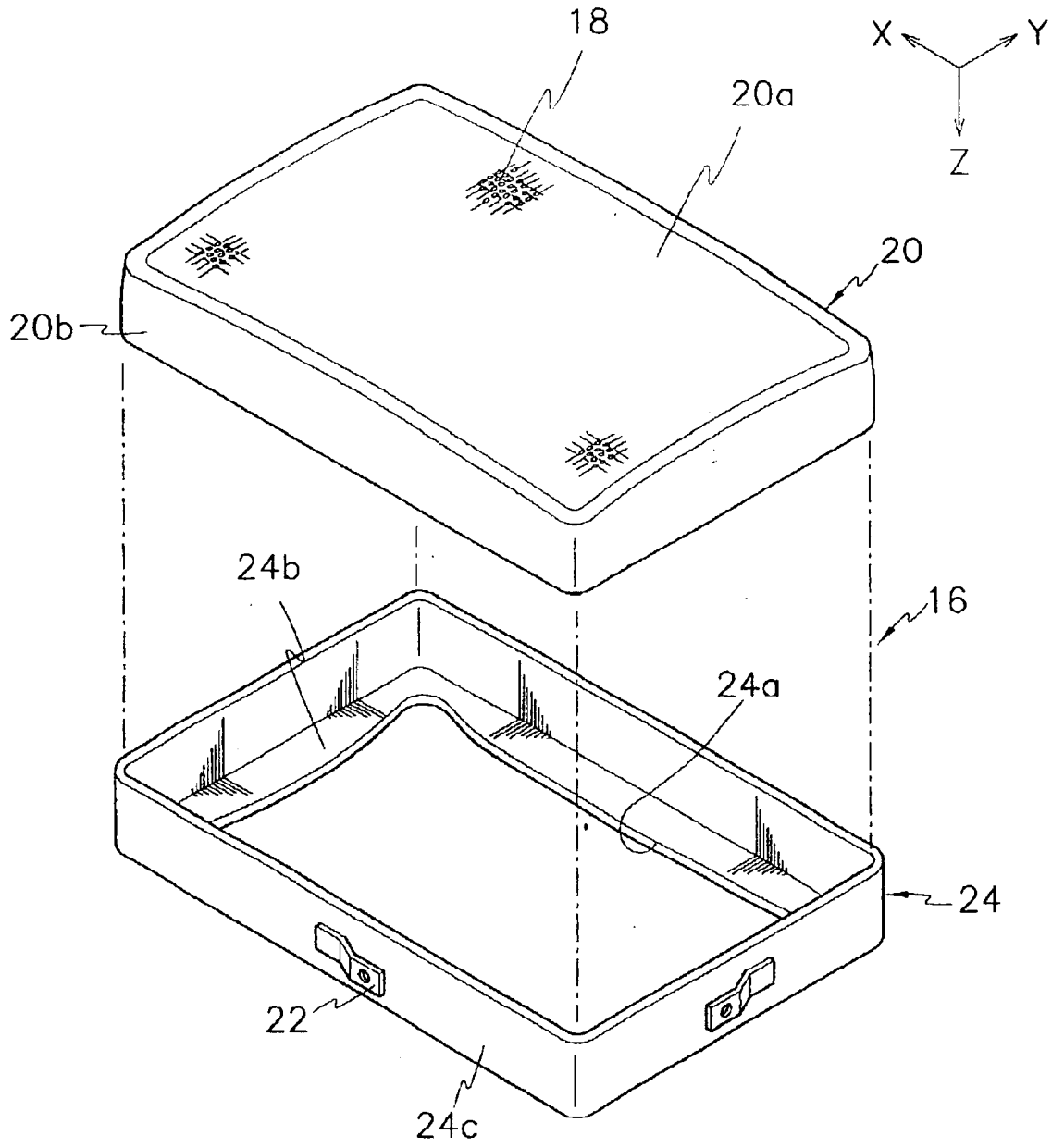
FIG. 2 is an exploded perspective view of a color selection apparatus of FIG. 1.

FIG. 1 is a partially cutaway sectional view of a cathode ray tube according to a preferred embodiment of the present invention, and FIG. 2 is an exploded perspective view of a color selection apparatus of FIG. 1.

The cathode ray tube (CRT) is defined by a tube 8 that is realized by fusing a face panel 2, a funnel 4, and a neck 6 into an integral unit. Air in the tube 8 is evacuated such that a high vacuum state of approximately $10^{-7}$ torr is maintained therein.

A phosphor screen 10 including a plurality of red (R), green (G), and blue (B) phosphor layers is formed on an inner surface of the face panel 2. Also, an electron gun 12 that emits three electron beams toward the phosphor screen 10 is mounted within the neck 6, and a deflection apparatus 14 generating a magnetic field that deflects the electron beams is mounted on an outer circumference of the funnel 4.

A color selection apparatus 16 is mounted within the tube 8 at a predetermined distance from the phosphor screen 10. The color selection apparatus 16 includes a shadow mask 20 that has a plurality of apertures 18 formed therein providing the passage of electron beams, and a mask frame 24 fixed to four corners of the shadow mask 20 to support the shadow mask 20 and fixed also to an inside of the face panel 2 through spring members 22.

Apertures 18 are formed in an effective area 20*a* of the shadow mask 20, the effective area 20*a* having a curved surface and roughly corresponding to an area of the phosphor screen 10. The apertures 18 may be dot shaped. Also, a skirt 20*b* extends from edges of the effective area 20*a* and is bent at a predetermined angle (i.e., substantially normal to an X-Y plane in the drawings). The skirt 20*b* is fixed to the mask frame 24.

The mask frame 24 includes a bottom portion 24*b* that is formed substantially on the X-Y plane in the drawings. An opening 24*a* of a predetermined size is formed in a center of the bottom portion 24*b* of the mask frame 24. The mask frame 24 also includes side walls 24*c* that extend toward the phosphor screen 10. The skirt 20*b* of the shadow mask 20 is connected to the side walls 24*c* of the mask frame 24.

Three electron beams corresponding to R, G, B image signals are emitted from the electron gun 12, and are deflected by the magnetic field generated by the deflection apparatus 14 to form scanning lines. After merging at one aperture 18 of the shadow mask 20, the electron beams pass through the particular aperture 18 and are separated to illuminate corresponding R, G, B phosphor layers of the phosphor screen 10.

Figure 3:
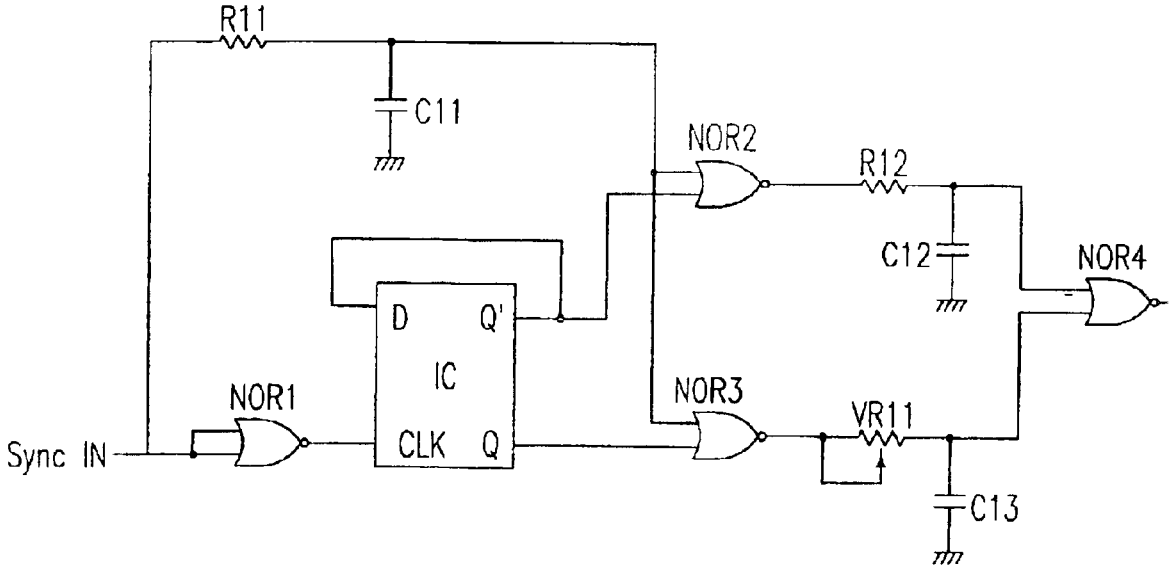
FIG.3 (Prior Art)
FIG. 3 is schematic diagram of a moire compensation circuit.

A moire compensation circuit reducing moire is included in a circuit portion (not shown) that supplies a deflection current to the deflection apparatus 14. The moire compensation circuit causes interference in a vertical deflection signal supplied to the deflection apparatus 14 such that a vertical position of the electron beams continuously vibrates, thereby effectively increasing a vertical diameter of the electron beams. FIG. 3 shows a moire compensation circuit disclosed in U.S. Pat. No. 5,107,188 that operates in this manner.

As shown in FIG. 3, a video synchronization signal (Sync IN) is input to a first NOR gate (NOR1), and it is also delayed by a resistor (R11) and a capacitor (C11) to be input to a second NOR gate (NOR2) and a third NOR gate (NOR3). An output signal of the first NOR gate (NOR1) is input to a clock terminal of counter (IC), which is realized by a D flip-flop, a Q' output terminal of the counter (IC) is connected to a D input terminal (DATA input terminal), and the output of a Q output terminal is toggled between 'high' and 'low' logic signals.

The Q' output terminal of the counter (IC) is connected to the second NOR gate (NOR2) and the output terminal Q is connected to the third NOR gate (NOR3). An output signal of the second NOR gate (NOR2) passes through a resistor (R12) and a capacitor (C12) to be input to a fourth NOR gate (NOR4). Further, an output signal of the third NOR gate (NOR3) passes through a variable resistor (VR1) and a capacitor (C13) to be input to the fourth NOR gate (NOR4). Finally, a delayed synchronization signal is output from an output terminal of the fourth NOR gate (NOR4).

The vertical synchronization signal is repeatedly delayed by the moire compensation circuit such that the vertical position of the electron beams is varied. Therefore, the vertical diameters of the electron beams are increased such that the intensity of moire interference waves is reduced and the moire phenomenon is minimized. However, if the vertical position of the electron beams undergoes excessive vibration, shaking of the picture results such that it is necessary to operate the moire compensation circuit in a range that prevents this from occurring.

The moire compensation circuit structured as in the above is merely one example of a circuit that may be applied to the CRT according to an embodiment of the present invention to minimize the moire phenomenon. It is to be understood that other circuit configurations may also be used.

Figure 4:
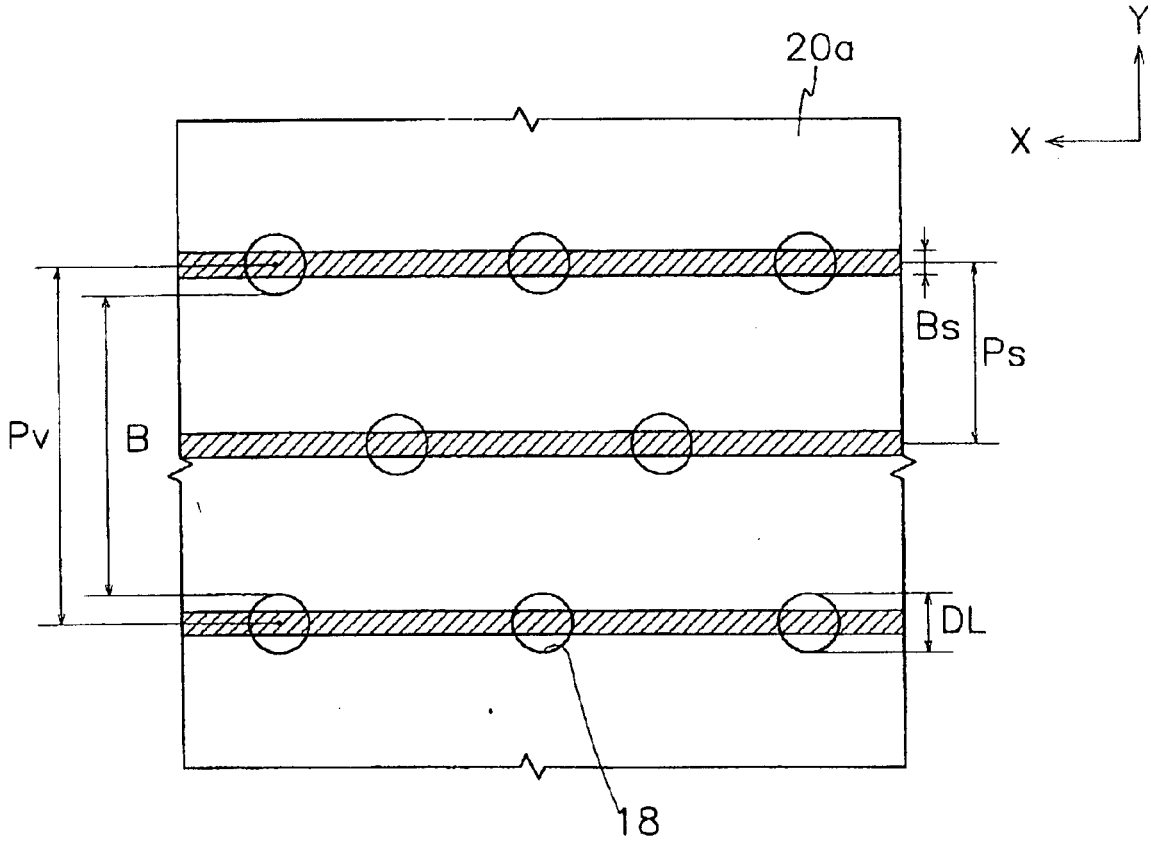
FIG. 4 is a partially exploded view of an effective area of a shadow mask of FIG. 2.

FIG. 4 is a partially exploded view of the effective area 20*a* of the shadow mask 20. In the drawing, a portion of a side of the effective area 20*a* that faces the electron gun 12 is enlarged.

The apertures 18 are formed at predetermined intervals in a horizontal direction (X direction) and a vertical direction (Y direction) to form a predetermined pattern. In the drawing, Pv is a vertical pitch of the apertures 18 (i.e., a distance between centers of two apertures 18 aligned along the Y direction), B is a length of a bridge (i.e., a length of a non-etched portion between two apertures 18 aligned along the Y direction), and DL is a vertical length of the apertures 18 (i.e., a length of the apertures 18 in the Y direction).

The electron beams emitted from the electron gun 12 scan (in a periodic manner) the shadow mask 20 along horizontally-arranged rows of the apertures 18. Bs in FIG. 4 indicates a vertical diameter of the electron beams landing on the effective area 20*a* of the shadow mask 20, and Ps indicates a vertical pitch of the electron beams landing on the effective area 20*a* of the shadow mask 20 (i.e., a distance between centers of paths of two adjacent electron beams in the Y direction).

The vertical pitch of the electron beams indicated by Ps may be calculated by dividing the size of the screen into a user-selected resolution mode. For example, in the case of a 19-inch CRT monitor, Ps is calculated as 0.264 mm in a 1280×1024 resolution mode. However, the actual electron beams are scanned overlapping, unlike what is shown in the drawing.

The vertical diameters of the electron beams indicated by Bs are ideally identical over the entire effective area 20*a* of the shadow mask 20. However, because of the characteristics of the electric field used for deflection, the further the electron beams are deflected toward the horizontal ends of the effective area 20*a*, the greater the reduction in the vertical diameters of the electron beams. This results in an increase in moire intensity.

Factors that affect moire intensity include the vertical diameter Bs of the electron beams, the vertical pitch Ps of the electron beams, the vertical length DL of the apertures 18, and the vertical pitch Pv of the apertures 18. These factors can be combined as shown in Equation 1 below to define K.

$$K = \frac{DL}{Pv} \times \frac{Bs}{Ps} \qquad \text{\{Equation 1\}}$$

In Equation 1, since Bs is included as a coefficient to determine K, increases in the value of K as the horizontal edges of the effective area 20*a* are reached are directly proportional to variations in Bs, and the value of K is proportional to the moire intensity.

Varying the vertical length DL of the apertures 18 and the vertical pitch Pv of the apertures 18 controls the value of K at the horizontal edges of the effective area 20*a*. The moire intensity at the horizontal edges of the effective area 20*a* can be adjusted to a level approaching the level found at the center of the effective area 20*a*. To this end, an optimal K value was obtained (so that a moire pattern is not generated) through experimentation as follows.

Figure 5:
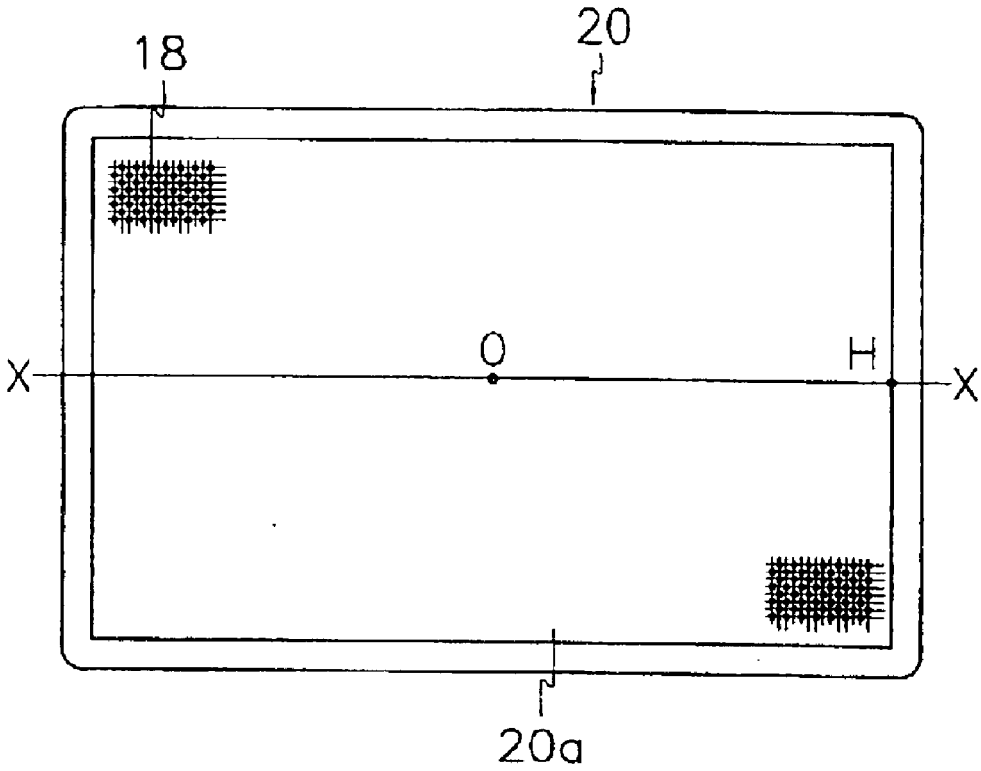
FIG. 5 is a plan view of an effective area of the shadow mask of FIG. 2.
Figure 6:
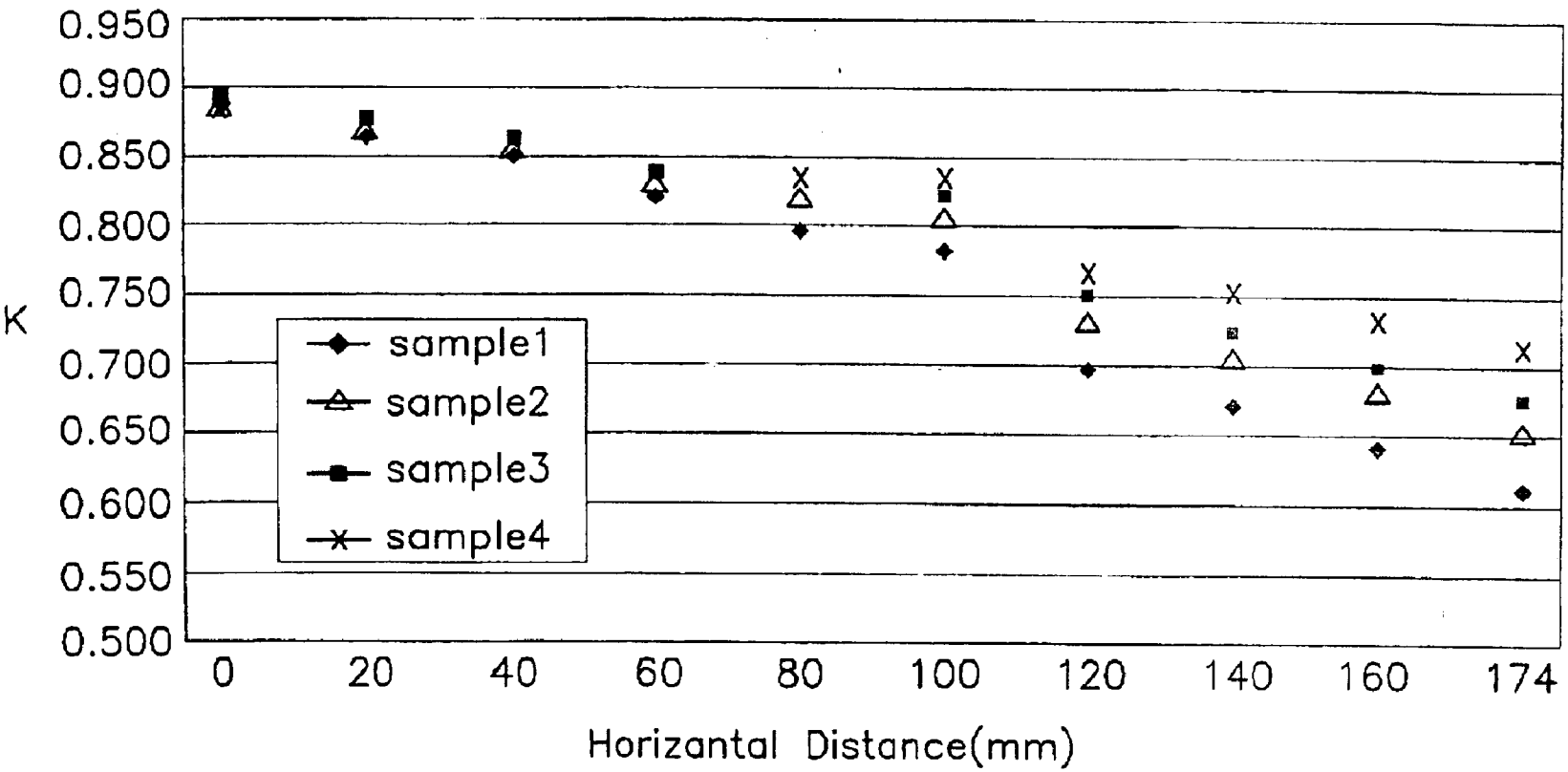
FIG. 6 is a graph showing K variations as a function of horizontal positions of each sample item of Table 1.

Four sample shadow masks were used in which vertical lengths DL and vertical pitches Pv of the apertures 18 were varied. The shadow masks were those applicable to a 19-inch CRT monitor of a 1280×1024 resolution mode. Further, in each of the shadow masks, with reference to FIG. 5, K values were measured along a horizontal axis formed by connecting a center point of the effective area 20*a* (indicated by O in the drawing) and a horizontal end (indicated by H in the drawing) of the effective area 20*a*. The K values for each sample are shown plotted on the graph of FIG. 6, which shows the change in the K values as a function of horizontal position.

Figure 7:
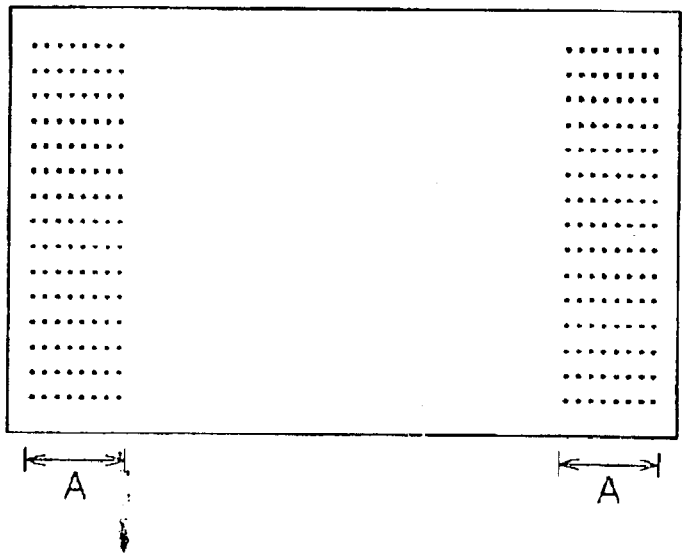
FIG. 7 is a schematic view of a screen of a cathode ray tube showing regions of moire phenomenon appearing in Table 1.
Figure 8:
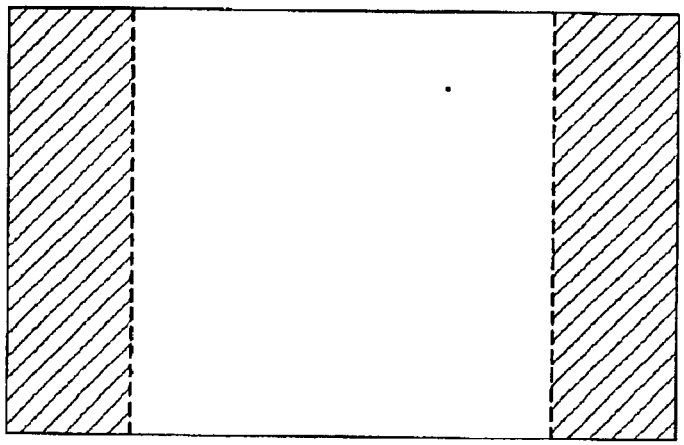
FIG.8(Prior Art)
FIG. 8 is a schematic view of a screen of a conventional cathode ray tube showing areas of moire phenomenon.

The K value at the center point O of the effective area 20*a* was designated as Ko and the K value at the horizontal end H of the effective area 20*a* was designated as Ke. Ke/Ko values for each sample and sizes of regions of moire generation according to whether the moire compensation circuit is activated or deactivated are shown in Table 1 below. In the table, the numerical expression of the sizes of the regions of moire generation refer to horizontal lengths of the moire generation regions at left and right edges of the screen as indicated by A in FIG. 7. The lengths A of the moire generation regions are in millimeters.

TABLE 1

| | | Size of Moire Generation Region | |
|---|---|---|---|
| Sample No. | Ke/Ko | Moire Compensation Circuit OFF | Moire Compensation Circuit ON |
| 1 | 0.68 | 50 | 10~15 |
| 2 | 0.72 | 30 | 5~10 |
| 3 | 0.76 | 13 | 0 |
| 4 | 0.80 | 0 | 0 |

Accordingly, the more the K value at the horizontal end H of the effective area 20*a* approaches the K value at the center point O of the effective area 20*a* to increase the Ke/Ko value, the greater the reduction in the moire generation regions in the screen. In the case of sample 3, where the Ke/Ko value is 0.76, a significant improvement over samples 1 and 2 is realized.

In the case of sample 4, where the Ke/Ko value is 0.80, the occurrence of the moire phenomenon is fully prevented even if the moire compensation circuit is not activated. Such improvements in moire characteristics are identically realized in an 800×600 resolution mode. Also, the same results were obtained in CRT sizes other than the 19-inch CRT.

In the CRT including such a color selection apparatus, improvements in moire characteristics may be realized without affecting screen quality if the Ke/Ko value is set at 0.76 or higher.

As the ratio of the vertical pitch Pv of the apertures to the vertical length DL of the apertures 18 increases, the Ke/Ko value approaches 1.0. An excessive increase in the Ke/Ko value results in a reduction in a screen tolerance caused by misguiding the electron beams, and an increase in an area occupied by the apertures in the effective area 20*a* to thereby result in a reduction of the ability of the shadow mask 20 to withstand shocks. Therefore, it is preferable that the Ke/Ko value has an upper limit of 0.85 or less.

In consideration of the results as described above, the CRT according to an embodiment of the present invention should satisfy the condition as set forth in Equation 2 as follows:

$$0.76 \geq \frac{Ke}{Ko} \geq 0.85 \qquad \text{\{Equation 2\}}$$

If the Ke/Ko value is set at 0.80 or higher in the CRT according to an embodiment of the present invention, the occurrence of the moire phenomenon may be prevented even without the use of a moire compensation circuit. Such an omission of the moire compensation circuit from the CRT reduces overall costs.

Therefore, it is preferable that the CRT according to an embodiment of the present invention satisfies the condition as set forth in Equation 3 as follows.

$$0.80 \geq \frac{Ke}{Ko} \geq 0.85 \qquad \text{\{Equation 3\}}$$

In the CRT according to the embodiment of the present invention described above, the vertical length DL of the apertures 18, the vertical pitch Pv of the apertures 18, and the bridge length B are set such that the ratio between the K value at the center point of the effective area 20*a* and the K value at the horizontal end of the effective area 20*a* are in the range of 0.76~0.85, or more preferably in the range of 0.80~0.85 (so that a moire compensation circuit is not required in the CRT). Accordingly, in the CRT of the present invention, the moire intensity at horizontal edges of the screen is reduced to prevent the generation of moire patterns.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A cathode ray tube, comprising:

a tube including a face panel having an inner surface of which is formed a phosphor screen, a funnel connected to the face panel, and a neck connected to the funnel;

a color selection apparatus including a shadow mask having a plurality of apertures passing electron beams formed in an effective area of the shadow mask, and a mask frame mounted to an inside of the face panel while fixedly supporting the shadow mask;

an electron gun mounted within the neck and emitting the electron beams toward the phosphor screen;

a deflection apparatus mounted to an outer circumference of the funnel and generating a deflecting magnetic field in a path of the electron beams to deflect the electron beams; and a moire compensation circuit included in a circuit portion connected to the deflection apparatus, the moire compensation circuit causing interference in a deflecting signal supplied to the deflection apparatus to perform moire compensation;

wherein the color selection apparatus satisfies the following condition, $$0.76 \geq \frac{Ke}{Ko} \geq 0.85$$

where Ko is a K value at a center point of the effective area and Ke is a K value at a horizontal end of the effective area, and wherein K satisfies the following condition, $$K = \frac{DL}{Pv} \times \frac{Bs}{Ps}$$

where DL is a vertical length of the apertures, Pv is a vertical pitch of the apertures, Bs is vertical diameter of the electron beams landing on the effective area, and Ps is a vertical pitch of the electron beams landing on the effective area.

2. The cathode ray tube of claim 1, wherein the apertures formed in the shadow mask are dot-shaped apertures.

3. A cathode ray tube, comprising:

a tube including a face panel having an inner surface of which is formed a phosphor screen, a funnel connected to the face panel, and a neck connected to the funnel;

a color selection apparatus including a shadow mask having a plurality of apertures passing electron beams formed in an effective area of the shadow mask, and a mask frame mounted to an inside of the face panel while fixedly supporting the shadow mask;

an electron gun mounted within the neck and emitting the electron beams toward the phosphor screen; and a deflection apparatus mounted to an outer circumference of the funnel and generating a deflecting magnetic field in a path of the electron beams to deflect the electron beams;

wherein the color selection apparatus satisfies the following condition, $$0.80 \geq \frac{Ke}{Ko} \geq 0.85$$

where Ko is a K value at a center point of the effective area and Ke is a K value at a horizontal end of the effective area, and wherein K satisfies the following condition, $$K = \frac{DL}{Pv} \times \frac{Bs}{Ps}$$

where DL is a vertical length of the apertures, Pv is a vertical pitch of the apertures, Bs is vertical diameter of the electron beams landing on the effective area, and Ps is a vertical pitch of the electron beams landing on the effective area.

4. The cathode ray tube of claim 3, wherein the apertures formed in the shadow mask are dot-shaped apertures.

5. A shadow mask of a cathode ray tube, comprising:

a plurality of apertures passing electron beams formed in an effective area of the shadow mask, wherein the shadow mask satisfies the following condition, $$0.76 \geq \frac{Ke}{Ko} \geq 0.85$$

where Ko is a K value at a center point of the effective area and Ke is a K value at a horizontal end of the effective area, and wherein K satisfies the following condition, $$K = \frac{DL}{Pv} \times \frac{Bs}{Ps}$$

where DL is a vertical length of the apertures, Pv is a vertical pitch of the apertures, Bs is vertical diameter of the electron beams landing on the effective area, and Ps is a vertical pitch of the electron beams landing on the effective area.

6. A display system minimizing a moire pattern intensity on a display, comprising:

a color selection apparatus having a plurality of apertures passing electron beams formed in an effective area of the color selection apparatus, wherein the color selection apparatus satisfies the following condition, $$0.80 \geq \frac{Ke}{Ko} \geq 0.85$$

where Ko is a K value at a center point of the effective area and Ke is a K value at a horizontal end of the effective area, wherein K satisfies the following condition, $$K = \frac{DL}{Pv} \times \frac{Bs}{Ps}$$

where DL is a vertical length of the apertures, Pv is a vertical pitch of the apertures, Bs is vertical diameter of the electron beams landing on the effective area, and Ps is a vertical pitch of the electron beams landing on the effective area, and wherein the moire pattern intensity is minimized without using a moire compensation circuit; and a display comprising a phosphor screen configured to provide an image caused by directing the electron beams onto the phosphor screen.

7. The system of claim 6, wherein the display comprises:

a tube including a face panel having an inner surface of which is formed the phosphor screen, a funnel connected to the face panel, and a neck connected to the funnel;

an electron gun mounted within the neck and emitting the electron beams toward the phosphor screen; and a deflection apparatus mounted to an outer circumference of the funnel and generating a deflecting magnetic field in a path of the electron beams to deflect the electron beams.

8. The display system of claim 6, wherein the color selection apparatus comprises:

a shadow mask having the plurality of apertures formed in the effective area of the shadow mask passing the electron beams; and a mask frame mounted to an inside of the face panel and fixedly supporting the shadow mask.

* * * * *